US008429773B2

(12) United States Patent
Herman

(10) Patent No.: US 8,429,773 B2
(45) Date of Patent: Apr. 30, 2013

(54) SHEET SUSPENDERS

(76) Inventor: Sal Herman, Bloomfield Hills, MI (US)

( * ) Notice: Subject to any disclaimer, the term of this patent is extended or adjusted under 35 U.S.C. 154(b) by 0 days.

(21) Appl. No.: 13/227,253

(22) Filed: Sep. 7, 2011

(65) Prior Publication Data

US 2012/0060285 A1 Mar. 15, 2012

Related U.S. Application Data

(63) Continuation-in-part of application No. 13/198,469, filed on Aug. 4, 2011, which is a continuation-in-part of application No. 12/872,014, filed on Aug. 31, 2010, now Pat. No. 8,209,779.

(51) Int. Cl.
*A47C 21/02* (2006.01)

(52) U.S. Cl.
USPC ..... 5/498; 5/504.1; 5/922; 24/72.5

(58) Field of Classification Search ..... 5/498, 496, 5/504.1, 658, 923, 922; 24/72.5
See application file for complete search history.

(56) References Cited

U.S. PATENT DOCUMENTS

| | | | | |
|---|---|---|---|---|
| 3,901,579 | A * | 8/1975 | Demerest | 359/519 |
| 4,481,682 | A * | 11/1984 | Hall | 2/326 |
| 4,662,016 | A * | 5/1987 | Seeman | 5/658 |
| 4,829,617 | A * | 5/1989 | Dameron | 5/658 |
| 5,072,470 | A * | 12/1991 | Lysiak | 5/496 |
| 5,179,743 | A * | 1/1993 | Lanman | 5/498 |
| 5,433,222 | A * | 7/1995 | Boomgaarden et al. | 128/869 |
| 6,161,235 | A * | 12/2000 | Smith et al. | 5/504.1 |
| 6,185,766 | B1 * | 2/2001 | Farrugia | 5/498 |
| 6,923,357 | B2 * | 8/2005 | Smith | 224/605 |
| 7,841,635 | B2 * | 11/2010 | Fuchs | 294/150 |
| 8,209,779 | B2 * | 7/2012 | Herman | 2/327 |
| 2008/0042460 | A1 * | 2/2008 | Fuchs | 294/150 |
| 2009/0083899 | A1 * | 4/2009 | Herman | 2/323 |
| 2012/0060262 | A1 * | 3/2012 | Herman | 2/326 |
| 2012/0060285 | A1 * | 3/2012 | Herman | 5/498 |

* cited by examiner

*Primary Examiner* — Robert G Santos

(57) ABSTRACT

Suspender-type strap members for securing sheets and bedding to mattress and the like. The ends of the strap members have fasteners for securing the strap members to the sheet or bedding. The strap members can also be adjustable.

14 Claims, 7 Drawing Sheets

SHEET SUSPENDERS

CROSS-REFERENCE TO RELATED APPLICATIONS

This application is a continuation-in-part of U.S. patent application Ser. No. 13/198,469, filed on Aug. 4, 2011, which in turn is a continuation-in-part of U.S. patent application Ser. No. 12/872,014 filed on Aug. 31, 2010 now U.S. Pat. No. 8,209,779.

TECHNICAL FIELD

The present invention relates to suspenders and more particularly to suspenders designed to hold sheets, bedding and the like tightly in place.

BACKGROUND

Suspenders used to support pants or trousers on a person's body are in common use today. There are many types of known suspenders and they typically include a pair of straps which fit over the shoulders of the wearer and ends which attach to the waistband of the pants. The suspenders have a pair of straps extending vertically along the front torso of the wearer for attachment to the front of the pants, and at least one strap on the back of the wearer which also is adapted to be connected to the pants.

Suspenders to hold up socks are also known, although not as common as suspenders used to support pants or trousers. These suspenders typically have bands of elastic which are positioned around the wearer's calves, together with a short strap having a fastener for attachment to the wearer's socks.

The ends of the straps of the suspenders are attached in a number of ways. The straps typically are attached with buttons or clips. As to clips, various types of clips are in use today such as those found in U.S. Design Pat. Nos. D614,946 and D619,495.

Many of the known suspenders also have buckles near the ends of the straps in order to adjust the length of the straps. The ends of the straps are slipped through openings in the clips and extended back along the straps to the adjustment buckles. These buckles are unsightly, add bulges to any covering materials, and often are hard to operate.

Suspenders have uses whenever there is a need to hold a flexible material in place. Suspenders also can create smooth and unwrinkled materials which are more aesthetically pleasing.

Items such as bed sheets and other bedding materials are products which are difficult to keep in place or are difficult to maintain with a tight and smooth appearance.

SUMMARY OF THE INVENTION

Improved strap suspenders are provided which are used to hold sheets and bedding in place. The suspenders allow infinite adjustability of the straps and do not include buckles or other objects on the straps which could cause bulges or bumps.

In one embodiment, elongated straps are provided with clips at each end in order to hold sheets and other bedding materials in place. The straps can be positioned under a mattress to hold in place the edges of a top sheet which have been folded over the edges. At least a pair of straps are typically required to hold a sheet in place. The straps can be non-stretchable, but preferably are made from an elastic material. At least one end of each of the straps is positioned through a ring or the like which can make the length of the strap adjustable. The ends of these straps are preferably held in place by hook-and-loop fastening mechanisms, such as Velcro® materials.

The straps can be positioned in an X-shaped configuration extending from the corners of a mattress, or can be positioned in a parallel arrangement with the sides or ends of a mattress.

In another embodiment, a series of short strap members can be provided which can be used to secure each of the corners of a sheet under a mattress. Clips can be provided on the ends of the short straps and an adjustment mechanism is provided on at least one end of the straps.

At one end of the straps, the end can be slidingly passed through a ring member and securely attached or connected to the strap. This can be done by sewing. At the other end of the strap, the end is passed loosely through the ring members and is adjustable. These ends have pieces of a fastener material attached with a series of small hooks on it. The fastener materials are preferably pieces of hook-type Velcro® material and are glued or otherwise securely affixed to the end of the strap. It is also possible to have adjustable-type mechanisms on each end of each strap.

The material for the straps is provided on one side with a plurality of small loops along the surface. In this manner, the ends of the straps with the pieces of hook-type material on it can be positioned and secured anywhere on the strap. This provides significant benefits as to the ease of adjusting and releasing the suspender straps, as well as the elimination of buckles, bulges and bumps which show on any covering garments.

The opposite side of the strap material preferably has a smoother or harder surface. This allows other materials to slide freely over the straps without sticking or being hung-up.

The material for the straps also can be stretchable, which would further assist in the adjustability of the suspenders.

Other objects, features, benefits and advantages of the present application will become apparent from the following description of preferred embodiments of the invention when viewed in accordance with the accompanying drawings and appended claims.

DESCRIPTION OF THE PREFERRED EMBODIMENTS

Figure 1:
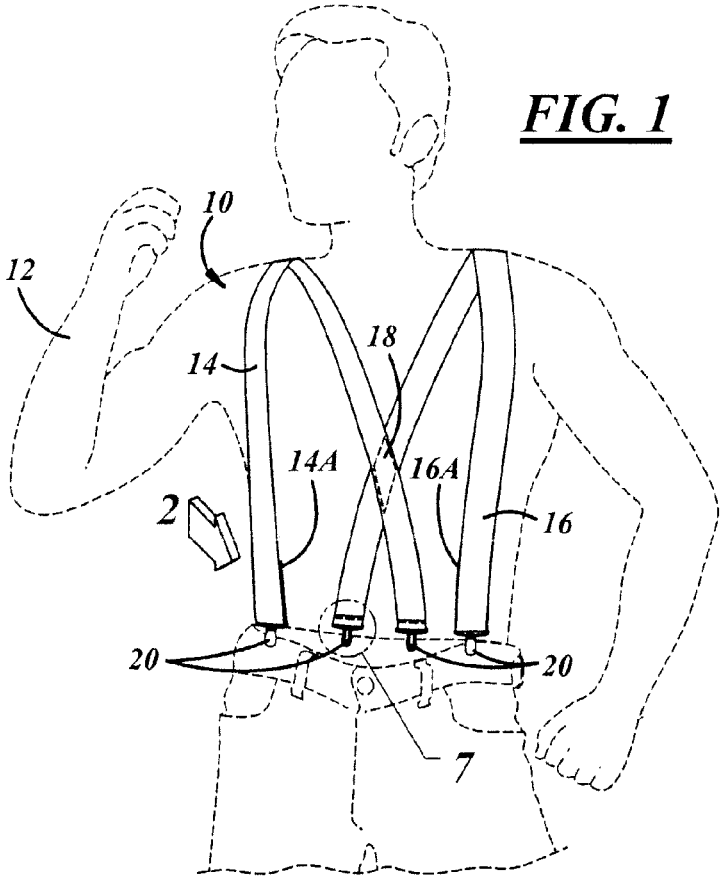
FIG. 1 is a first perspective view of pant-type suspenders as worn by a person.

An embodiment of the inventive pant-type suspender 10 is shown in FIG. 1 and is shown in a manner that it would be worn by a person or wearer 12. The suspender 10 includes a pair of strap members 14 and 16 which are attached together where they overlap 18 in a position at the back of a wearer when the suspender is worn.

Figure 2:
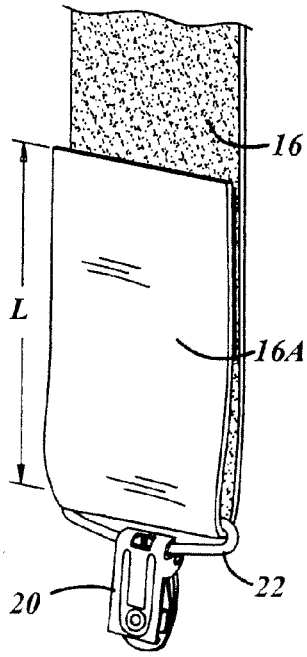
FIG. 2 is an enlarged view of a portion of FIG. 1.

Each of the strap members have a sufficient length to extend from the waistline at the rear of the wearer to the waistline at the front of the wearer, plus an additional amount which is used to adjust the suspenders for different sizes and shapes of wearers. These additional amounts are indicated by the reference numerals 14A and 16A in the drawings, as well as by "L" in FIG. 2.

The strap members 14 and 16 are attached together at 18 where they overlap. They can be connected together by any mechanism or method which securely affixes them together, such as by being sewn together.

In this regard, it should be understood that the invention is not to be limited to suspenders having the precise structure and configuration as shown in FIG. 1. The invention can be utilized with most all of the various sizes, shapes and strap configurations of suspenders known today, such as those shown, for example, in U.S. Design Pat. No. D243,293. Another embodiment of suspenders which can utilize the present invention is shown in FIGS. 8-11 and described below.

Fastener members 20 are used to connect the strap members to the pants or trousers worn by the wearer. Preferably, the fasteners 20 are clip-type fastener members, such as those shown in U.S. Design Pat. Nos. D614,946 and D619,495. However, the invention can be used with any type of conventional fastener members used with suspenders today, including buttons and snaps.

The fastener members 20 as shown have a loop or ring member 22 attached to them. The ring member 22 allows the strap members to slide through them.

Figure 7:
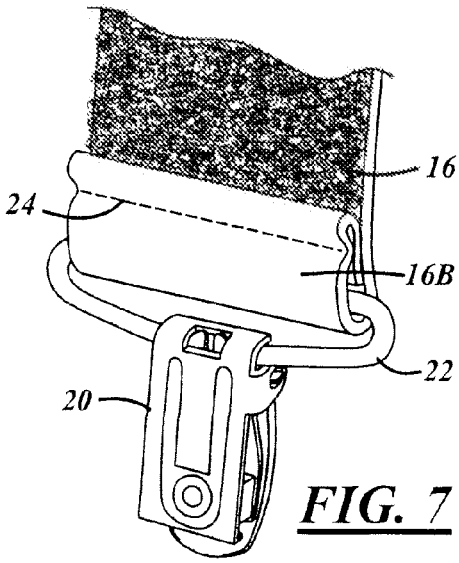
FIG. 7 depicts a fastener affixed to the end of a back strap member.
Figure 4:
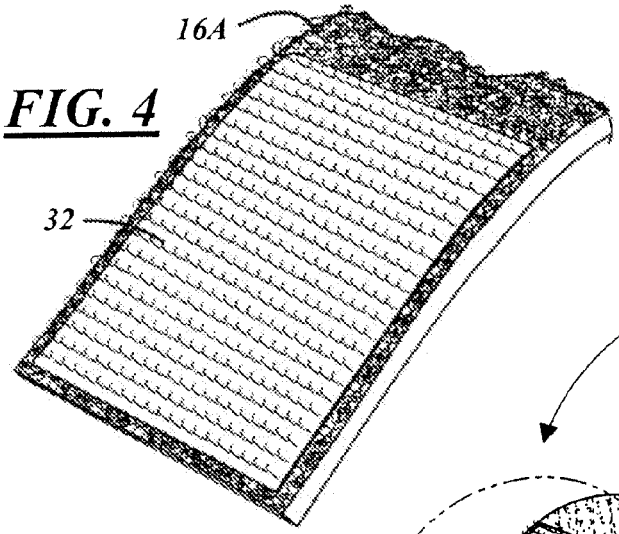
FIG. 4 is an enlarged view depicting the piece of material with hook members.

As to the portion of the suspenders which are to be positioned at the back of the wearer, the fastener members 20 are securely affixed to the ends of the strap members. This is shown, for example, in FIG. 7 where the end 16B of the strap member 16 is positioned through the ring member 22 and securely attached, such as by stitches 24 made by sewing, on the strap member. Preferably, both of the "rear" or "back" ends of the strap members 14 and 16 are connected to their respective fastener members in the same way.

Figure 3:
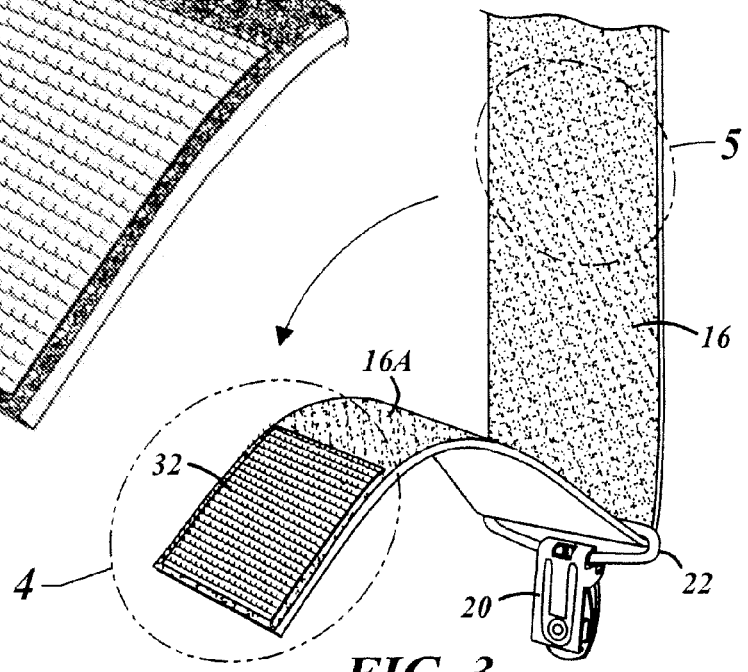
FIG. 3 depicts an unfastened end of a front strap.
Figure 5:
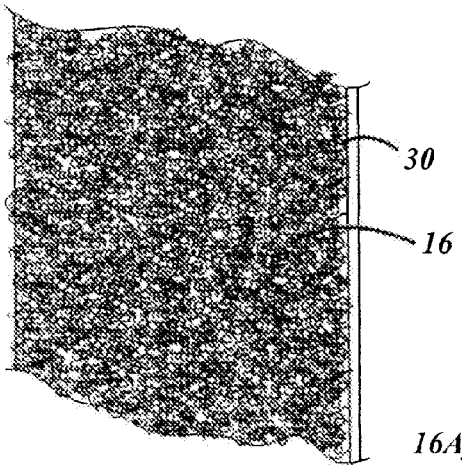
FIG. 5 is an enlarged view depicting the surface of the strap member with loop members.

The portion 16A of the strap member 16 is adapted to be secured at any position along the strap member that the wearer desires. This makes the suspenders essentially infinitely adjustable. For this purpose, the strap members are made of a material with a plurality of small loop members 30 on at least one surface. This is shown in FIGS. 3 and 5. Additionally, a piece of Velcro®-type hook material 32 is glued, sewn or otherwise securely affixed to the end portion 16A of the strap member 16. The piece of material 32 has a plurality of small hook members extending therefrom.

Figure 6:
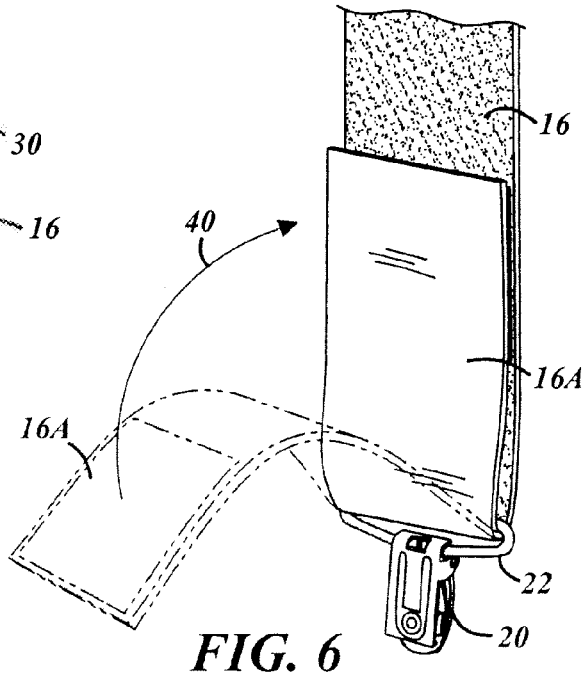
FIG. 6 illustrates the fastening of the end of a front strap member.

When the strap portion 16A is passed through the ring member 22 and pressed up against another portion of the strap member 16, some of the hook members on material 32 mate with some of the loop members 30 and secure the two items together. This movement is shown by arrow 40 in FIG. 6.

Although any type of material with hook members thereon can be used as material 32, preferably the material is one-half of a Velcro®-type fastening system.

Since the loop members 30 are present all along one of the surfaces of the strap members 14 and 16, the suspenders in accordance with the present invention are infinitely adjustable. This allows the suspenders to be easily adjusted to fit any body size or shape. It also allows a wearer to quickly and easily adjust the suspenders at any time for any reason, such as to make them more comfortable on certain days. This also allows the wearer to be able to unfasten the suspenders without undoing the front fasteners.

Although the above description relates specifically to strap member 16, it is to be understood that the same structure and members are to be used for strap member 14 and any other strap members in any other suspender configuration incorporating the present invention.

Preferably, the loop members 30 are provided only on one side of the strap members and this is the side which is worn adjacent the body of the person. (This also is what is shown in the drawings.) The other side of the strap members, that is the outer side, preferably has a smoother and harder surface. This allows outer garments to side easily over the strap members without catching or sticking. Of course, it is also possible that the strap members can have the same hook-type surfaces on both sides, or the suspenders could be worn with the hook side out.

The material used for the strap members 14 and 16 also can be stretchable or elastic. This would provide additional comfort and adjustability to the wearer.

Figure 8:
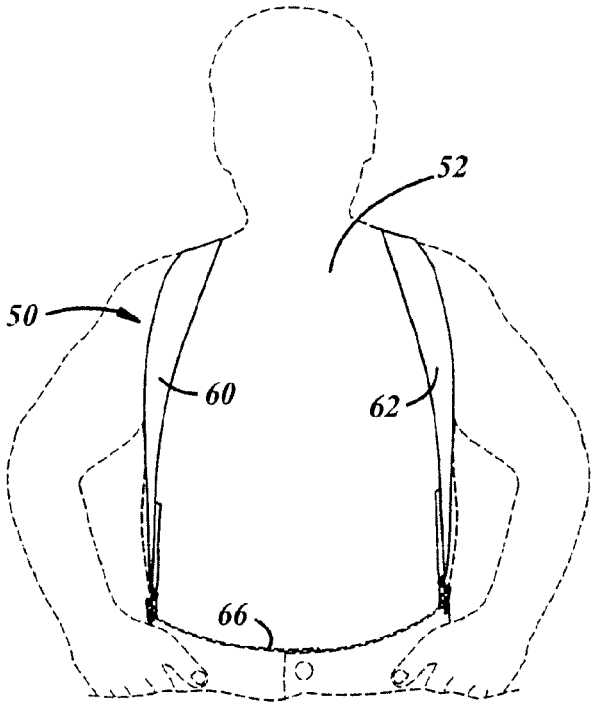
FIGS. 8-11 depict an alternate embodiment of the invention.
Figure 9:
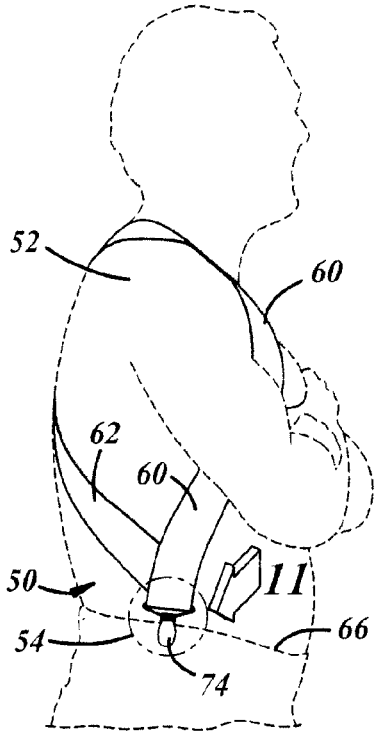
Figure 10:
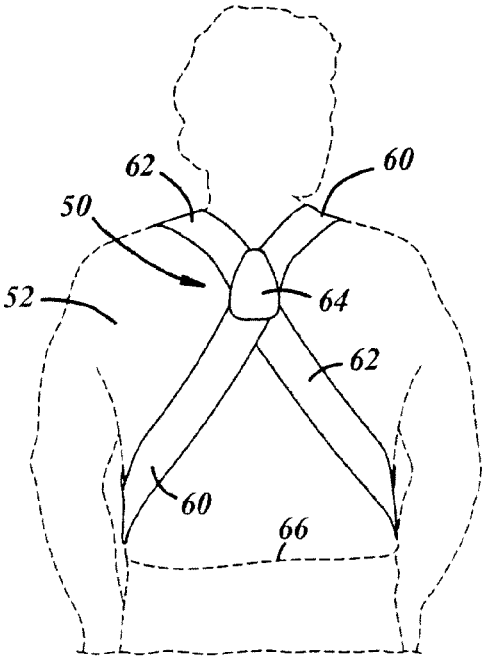
Figure 11:
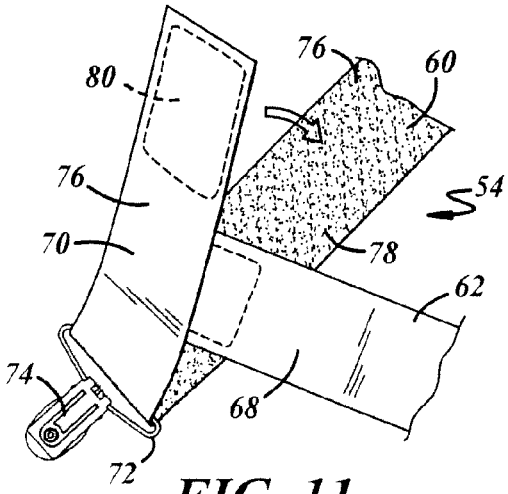

A second embodiment of the present invention is shown in FIGS. 8-11. The strap material, fasteners and adjustment system are preferably the same as those set forth above relative to FIGS. 1-7, although only two fasteners are needed. FIG. 8 depicts the front view of this embodiment 50 as worn by a person 52, while FIG. 9 is a side view and FIG. 10 is a back view. FIG. 11 is an enlarged view of a portion 54 of the figure shown in FIG. 9.

This embodiment is similar to that sold as "Hip-Clip Suspenders" by Hold-Up Suspender Company in Southfield, Mich.

The suspenders 50 have a pair of strap members 60 and 62. The strap members are connected together where they crossover each other 64 on the back or rear of the wearer. The strap members can be connected at 64 in any secure way, such as by sewing.

The strap members 60 and 62 are also attached to each other at a position on the sides of the wearer and adjacent the waistband 66 of the wearer's pants or trousers. This is shown for one side in FIG. 9. The attachment mechanism on the other side of the wearer is the same. The end 68 of strap member 62 is securely attached to strap member 60, while the end portion 70 of strap member 60 is passed through ring member 72 of fastener 74 and releasably attached to itself (at point 76 in FIG. 11). This is the adjustment system or mechanism for the suspenders and is substantially the same as the adjustment mechanism for suspenders 10 as described above.

In this regard, the outer side of surface 76 of the strap member preferably has a hard finish or texture which prevents sticking of any outer garments. The opposite side or surface 78 of the strap member has a plurality of small loop members therein. A piece of hook-type Velcro material 80 is secured to the end portion 70 of the strap member in order to mate with and be releasably fastened to the loop members.

Embodiments of a shirt-and-sock type suspender are shown in FIGS. 12-19. A preferred embodiment has a "Y"-type shape with two arm-type strap members adapted to be fastened to the wear's shirt and an elongated strap member adapted to be fastened to the wearer's sock. A pair of shirt-and-sock type suspenders are worn by the wearer in order to keep both socks tight and prevent them from falling, and at the same time keeping both sides of the wearer's shirt neat and inside the wearer's pants.

The embodiment shown in FIGS. 12-19 has three strap members secured together at the "V" of the "Y"-shaped suspender. The strap members all preferably are made of an elastic or stretchable-type material with a plurality of loop members on one side. The outer ends of each of the three strap members have fasteners attached thereon for securely holding in place either a skirt or a sock. At least the outer end of the elongated strap member has a hook-type Velco® material attached thereto and is adjustable. The outer ends of the two arm-type strap members are preferably fixedly secured to their fastener members, but they also can have hook-type materials attached to them so they also can be adjustable.

Figure 12:
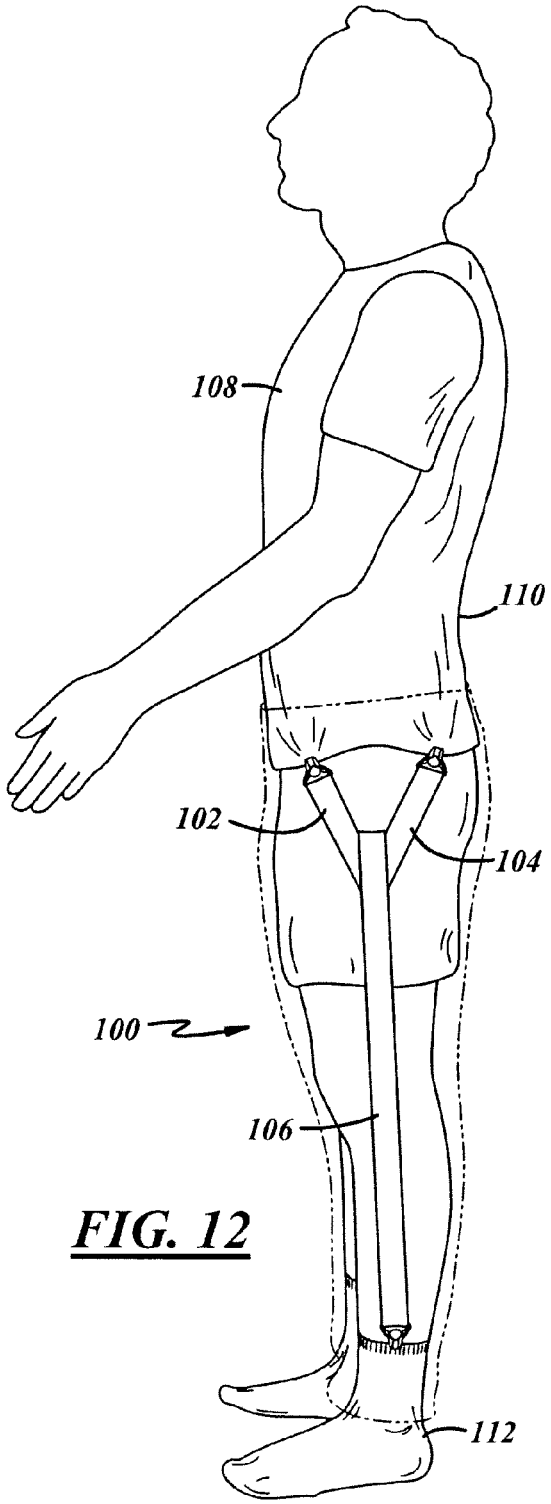
FIG. 12 is a perspective view of an embodiment of a shirt-and-socks type suspenders as worn by a person.
Figure 16:
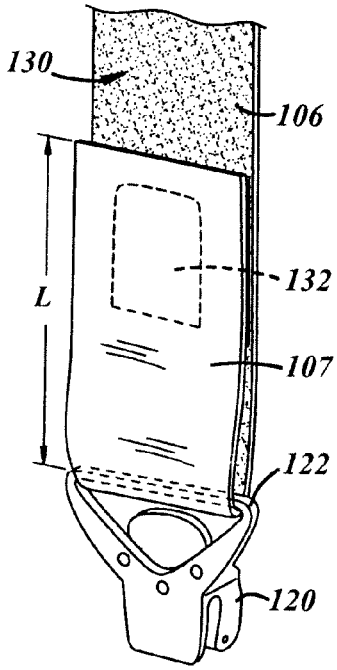
FIG. 16 depicts an infinitely adjustable fastener at the end of a strap member.
Figure 13:
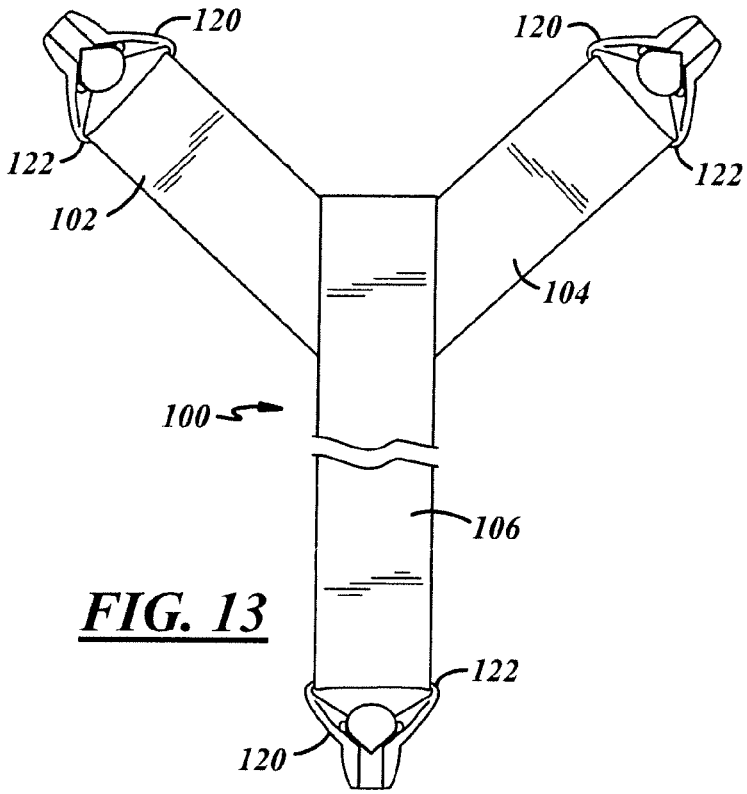
FIG. 13 is a front view of an embodiment of a shirt-and-sock type suspender in accordance with the present invention.
Figure 14:
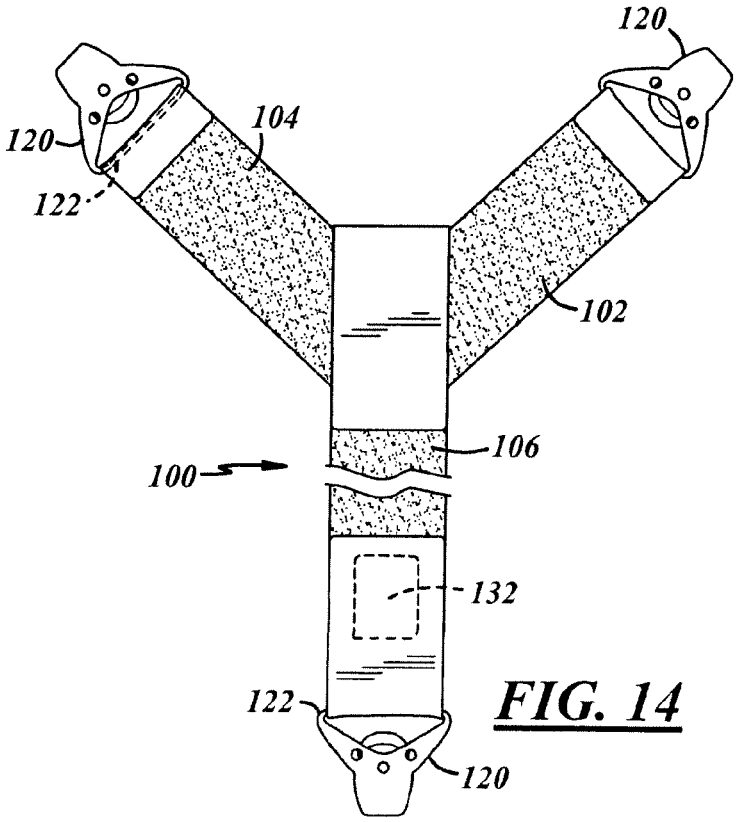
FIG. 14 is a rear view of an embodiment of a shirt-and-sock type suspender in accordance with the present invention.
Figure 15:
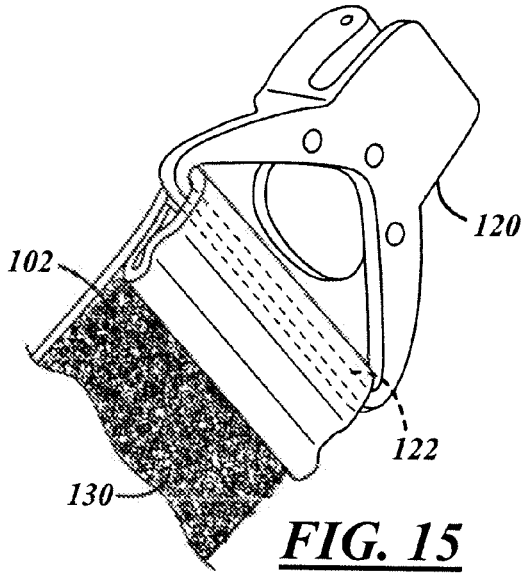
FIG. 15 depicts a fastener fixedly attached to the end of a strap member of the embodiment shown in FIGS. 13-14.

As shown in the embodiment illustrated in FIG. 12-14, the suspender 100 has a pair of arm-type strap members 102 and 104 attached to an elongated strap member 106. The three strap members are secured together in a "Y"-shaped configuration and are adapted to be worn by a wearer 108 in the manner shown in FIG. 12. The length of the suspender 100 is sufficient to extend from about the waist of the wear to the lower calf or ankle of the wearer in order to be attached at the upper end to the wearer's shirt 110 and at the other end to the wearer's sock 112. With a pair of suspenders 100, the wearer can maintain his shirt looking neat and always tucked in his/her pants, and at the same time, keep his/her socks tight and prevent them from falling.

In this regard, it should be understood that the invention is not to be limited to suspenders having the precise structure and configuration as shown in FIGS. 12-14. The invention can be utilized with other sizes, shapes and strap configurations of suspenders which fulfill the same objective and purpose.

Fastener members 120 are used to connect the strap members to the shirt or socks worn by the wearer. Preferably, the fasteners 120 are plastic clip-type fastener members, having the structure and fastening mechanism shown in the drawings. The fasteners can be any other conventional type of suspender fasteners, however, such as those shown in U.S. Design Pat. Nos. D614,946 and D619,495. The invention can also be used with other types of conventional fastener members used with suspenders today, including buttons and snaps.

Preferably, the three fastener members 120 on each suspender 100 are the same, but each could also be different from one another. As shown, each fastener has a loop or ring member 122 attached to them. The ring member 122 allows the strap members to slide through them.

The end portion 107 of the elongated strap member 106 is adapted to be secured at any position along the strap member that the wearer desires. This makes the suspender 100 essentially infinitely adjustable to fit and extend between the wearer's shirt and socks. For this purpose, the strap member 106 preferably is made of a material with a plurality of small loop members 130 on at least one surface. This is shown in FIGS. 14-17. Additionally, a piece of Velcro®-type hook material 132 is glued, sewn or otherwise securely affixed to the end portion 107 of the strap member 106. The piece of material 132 has a plurality of small hook members extending therefrom. (This is the same as the embodiment described above with reference to FIGS. 3-4.)

When the strap portion 107 is passed through the ring member 122 and pressed up against another portion of the strap member 106, some of the hook members on material 132 mate with some of the loop members 130 and secure the two items together. This movement is shown by arrow 40 in FIG. 6. This is the same as the pant-type suspenders described above with reference to FIGS. 2-6.

Although any type of material with hook members thereon can be used as material 132, preferably the material is one-half of a Velcro®-type fastening system.

Since the loop members 130 are present all along one of the surfaces of the strap 106, the suspender is infinitely adjustable. This allows the suspenders to be easily adjusted to fit any body size or shape. It also allows a wearer to quickly and easily adjust the suspenders at any time for any reason, such as to make them more comfortable on certain days.

Although the above description relates specifically to strap member 106, it is to be understood that the same structure and members can be used for strap members 102 and 104 and any other strap members in any other suspender configuration incorporating the present invention. In accordance with a preferred embodiment of the invention, however, the end portions of the strap members 102 and 104 are fixedly secured to the ring member of the fasteners 120, in the manner shown in FIG. 15 and described above with respect to FIG. 7.

The loop members 130 are provided only on one side of the strap members and this can be the side which is worn adjacent the body of the person or worn facing outwardly. The other side of the strap members preferably has a smoother and harder surface. If the smoother and harder side is worn outwardly, this will allow outer garments to slide more easily over the strap members without catching or sticking. Of course, it is also possible that the strap members can have the same hook-type surfaces on both sides, or the suspenders could be worn with the hook side out.

The material used for the strap members 102, 104 and 106 also preferably is stretchable or elastic. This would provide additional comfort and adjustability to the wearer.

Figure 17:
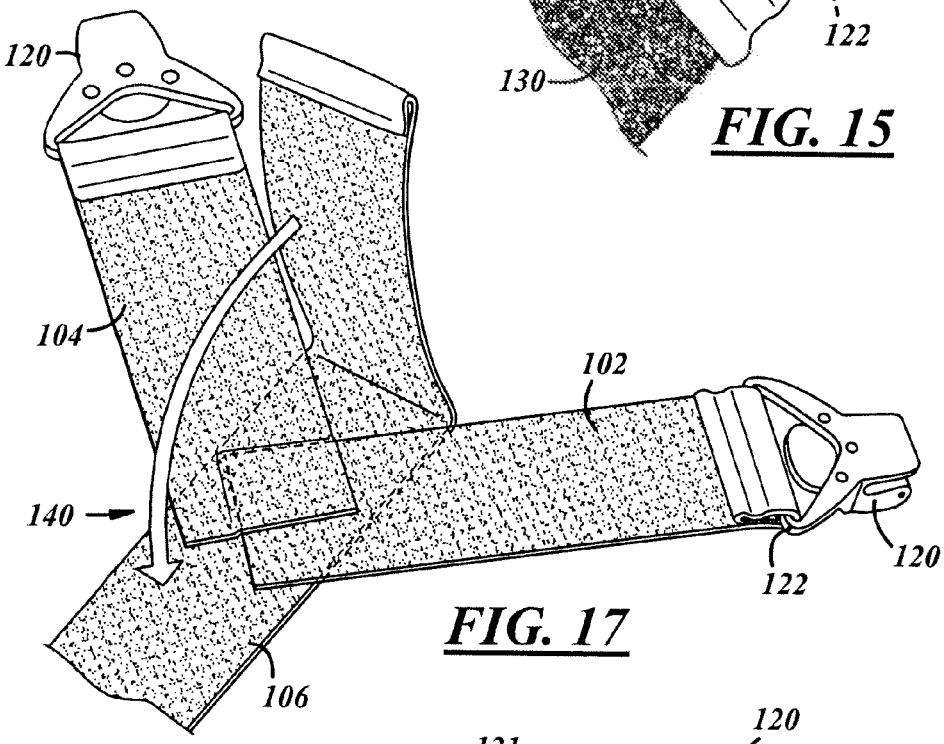
FIG. 17 illustrates the attachment of an elongated strap member to two arm members.

The three strap members 102, 104 and 106 are attached together at the "V" 140 of the suspenders where they overlap. This is shown in FIG. 17. The straps can be secured together at 140 by any mechanism or method which securely affixes them together, such as by being glued or being sewn together.

Figure 18:
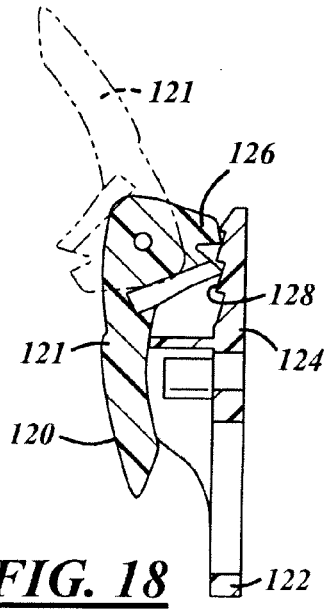
FIG. 18 depicts a fastener for use with an embodiment of a skirt-and-socks type suspender illustrating its open and closed positions.
Figure 19:
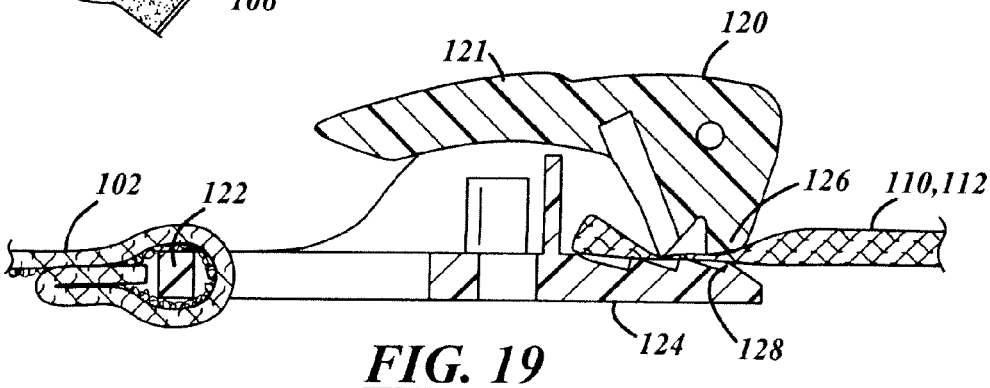
FIG. 19 depicts a fastener for use with an embodiment of a skirt-and-socks type suspender in a closed position holding a shirt garment or a sock.

FIGS. 18 and 19 illustrate the operation of preferred fasteners 120 used with the present invention. FIG. 18 shows the fastener 120 in the open and closed positions. The locking member 121 is pivotably attached to the base member 124 and has a series of ridges 126 which, when closed, interlock with mating ridges 128 on the base member. FIG. 19 shows the fastener 120 in the closed or locked position securely holding onto a piece of material 110, 112 which could be the shirt tail of a wearer's shirt or the upper part of a wearer's sock.

Figure 20:
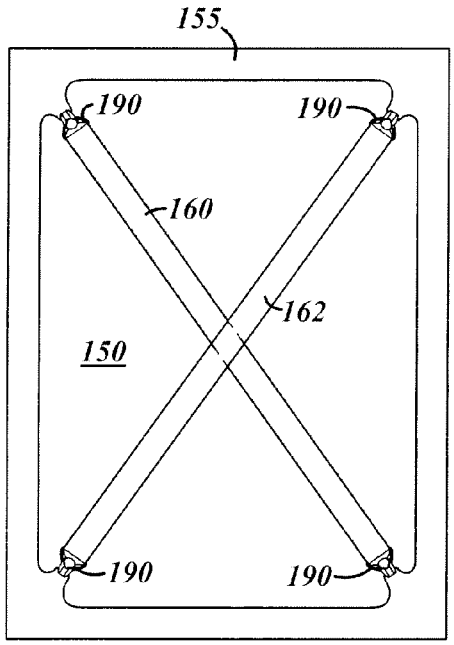
FIG. 20 depicts an embodiment of the inventive suspender straps used for holding a sheet to a mattress.
Figure 21:
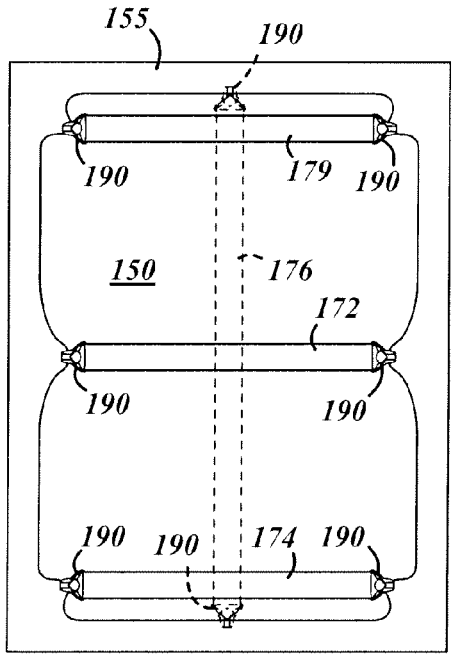
FIG. 21 depicts an alternate embodiment of the inventive suspender straps used for holding sheets on mattresses.
Figure 22:
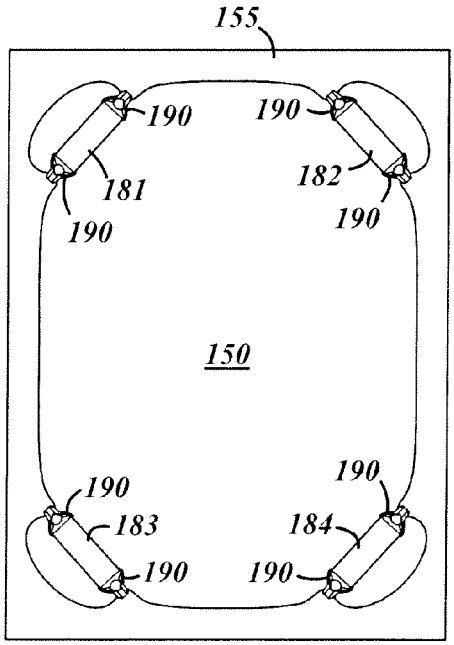
FIG. 22 depicts another alternate embodiment of the inventive suspender straps used for holding sheets on mattresses.

FIGS. 20-22 depict additional embodiments of the suspender strap members being used in other areas. As mentioned above, the present invention can be used in many different areas for different suspender-type products. In FIGS. 20-22, the strap members are used to secure bedding materials, such as sheets, to a mattress or the like.

In FIGS. 20-22, the mattresses are identified by the reference numeral 150 and the sheets by the reference numeral 155. It is to be understood that these embodiments of the invention should not necessarily be limited to use with sheets and mattresses, but have applicability and can be used to hold other materials on or around other products and devices.

In FIG. 20, a pair of strap members 160 and 162 are provided. The strap members are positioned in a X-shaped position under the mattress in order to hold the sheet member 155 tightly in place. In FIG. 21, three strap members 170, 172 and 174 are provided and are positioned parallel to the ends of the mattress 150 and hold the sheet member 155 tightly in place. As an alternative or addition to this strap arrangement, a strap member 176 can be provided extending down the length of the mattress (as shown). Additional secured strap members (not shown) could also be provided extending in the same direction. Combinations of the strap member systems as shown in FIGS. 20-21 could also be provided.

In FIG. 22, a series of short strap members 180, 181, 182, 183 are provided. These strap members are preferably positioned diagonally in the corners of the mattress 150 to hold the sheet member 155 tightly in place as shown.

Clip members 190 are provided at the ends of each of the strap members in the embodiments shown in FIGS. 20-22 in order to attach the strap members to the sheet members 155. The clip members are preferably the same as clip members 120 described above and as shown in FIGS. 13-19. Other clips or fastener members could also be provided in accordance with the present invention in order to fasten the suspender strap members to the sheet members.

The clip members 190 have ring members and allow the strap members to pass through them in the same manner as set forth above with respect to clip members 20 and 120. The ends of the strap members 160, 162, 170, 172, 174, 176, 181, 182, 183 and 184 can be fixedly secured to the clip members, as shown above with respect to FIG. 7, or can be releasably secured thereto in the manner set forth above with respect to FIGS. 2-6 and FIGS. 11 and 16.

The strap members used in FIGS. 20-22 are preferably made from the same material as set forth above with respect to FIGS. 1-19. Preferably, small loop members are provided on at least one side of each of the strap members, in the same manner as with strap members described above.

The strap members can also be made from an elastic or stretchable material, or can be non-stretchable.

The present invention eliminates the metallic or plastic buckles that are in use today in most suspenders for adjustment of the straps on the wearers. This eliminates the possibility of unsightly bumps or bulges under outer materials. The unique shirt-and-sock type invention keeps the wearer's shirt neat and tucked in and at the same time keeps the wearer's socks from falling. The unique sheet suspender invention keeps sheets and other bedding tight and in place on a mattress or other similar members.

Although the invention has been described with respect to preferred embodiments, it is to be also understood that it is not to be so limited since changes and modifications can be made therein which are within the full scope of this invention as detailed by the following claims.

What is claimed is:

1. A strap securing system for securing a sheet material on a product, said system comprising:

a pair of strap members, each strap member being made of an elastic stretchable material and having a first end portion and a second end portion;

first fastener members positioned at the first end portion of each strap member;

second fastener members positioned at the second end portion of each strap member;

said first fastener members having ring members through which said first end portions are positioned passing through;

a first surface of each of said strap members having loop-type members along substantially the entire longitudinal length thereof; and securing members having hook-type members thereon, said securing members attached to said first surfaces of each of said strap members and positioned adjacent said first end portions;

wherein said hook-type members can be mated with and releasably connected to loop-type members on said first surfaces at any location along the longitudinal length thereon;

wherein said first and second fastener members of said pair of strap members can securely secure a sheet material on a product.

2. The strap securing system as described in claim 1 wherein said first and second fastener members are clip-type fasteners.

3. The strap securing system as described in claim 1 wherein said second fastener members are securely fixed to said second end portions of said strap members.

4. The strap securing system as described in claim 1 wherein said second fastener members having ring members through which said second end portions are positioned passing through, and wherein securing members having hook-type members thereon, are attached to said first surfaces of each of said strap members and positioned adjacent said second end portions.

5. The strap securing system as described in claim 1 wherein the surfaces of the strap members opposite said first surfaces are smooth.

6. The strap securing system as described in claim 1 wherein said strap members can be utilized to tightly secure a sheet member to a mattress.

7. The strap securing system as described in claim 6 wherein said strap members form an X-shape in order to secure a sheet member to a mattress.

8. A strap securing system for securing a sheet material on a product, said system comprising:

a plurality of strap members, each strap member being made of an elastic stretchable material and having a first end portion and a second end portion;

first fastener members positioned at the first end portion of each strap member;

second fastener members positioned at the second end portion of each strap member;

said first fastener members having ring members through which said first end portions are positioned passing through;

a first surface of each of said strap members having loop-type members along substantially the entire longitudinal length thereof; and securing members having hook-type members thereon, said securing members attached to said first surfaces of each of said strap members and positioned adjacent said first end portions;

wherein said hook-type members can be mated with and releasably connected to loop-type members on said first surfaces at any location along the longitudinal length thereon;

wherein said first and second fastener members of said plurality of strap members can securely secure a sheet member on a product.

9. The strap securing system as described in claim 8 wherein at least three strap members can be used to secure a sheet member to a mattress.

10. The strap securing system as described in claim 8 wherein at least four strap members can be used to secure a sheet member to a mattress.

11. The strap securing system as described in claim 8 wherein said first and second fastener members are clip-type fasteners.

12. The strap securing system as described in claim 8 wherein said second fastener members are securely fixed to said second end portions of said strap members.

13. The strap securing system as described in claim 8 wherein said second fastener members having ring members through which said second end portions are positioned passing through, and wherein securing members having hook-type members thereon, are attached to said first surfaces of each of said strap members and positioned adjacent said second end portions.

14. The strap securing system as described in claim 8 wherein the surfaces of the strap members opposite said first surfaces are smooth.

* * * * *